US008271267B2

(12) United States Patent
Sung et al.

(10) Patent No.: US 8,271,267 B2
(45) Date of Patent: Sep. 18, 2012

(54) SCALABLE SPEECH CODING/DECODING APPARATUS, METHOD, AND MEDIUM HAVING MIXED STRUCTURE

(75) Inventors: Hosang Sung, Yongin-si (KR); Sangwook Kim, Seoul (KR); Rakesh Taori, Suwon-si (KR); Kangeun Lee, Gangneung-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1430 days.

(21) Appl. No.: 11/490,139

(22) Filed: Jul. 21, 2006

(65) Prior Publication Data

US 2007/0033023 A1 Feb. 8, 2007

Related U.S. Application Data

(60) Provisional application No. 60/701,502, filed on Jul. 22, 2005.

(30) Foreign Application Priority Data

May 30, 2006 (KR) ..... 10-2006-0049038

(51) Int. Cl.
*G10L 21/00* (2006.01)

(52) U.S. Cl. ..... 704/201; 704/219

(58) Field of Classification Search ..... 704/201, 704/219

See application file for complete search history.

(56) References Cited

U.S. PATENT DOCUMENTS 5,455,888 A 10/1995 Iyengar et al.
5,819,212 A * 10/1998 Matsumoto et al. ..... 704/219
6,895,375 B2 5/2005 Malah et al.
7,177,804 B2 * 2/2007 Wang et al. ..... 704/219
7,469,206 B2 * 12/2008 Kjorling et al. ..... 704/205
7,562,021 B2 * 7/2009 Mehrotra et al. ..... 704/500
7,624,022 B2 * 11/2009 Son et al. ..... 704/503
2002/0007273 A1 * 1/2002 Chen ..... 704/229

(Continued)

FOREIGN PATENT DOCUMENTS

KR 10-2004-0050141 6/2004

OTHER PUBLICATIONS

Geiser, P. Jax, P. Vary, H. Taddei, S. Schandl, M. Gartner, C. Guillaumé,and S. Ragot, "Bandwidth extension for hierarchical speech and audio codingin ITU-T Rec. G.729.1," IEEE Transactions on Audio, Speech, and LanguageProcessing, vol. 15, No. 8, pp. 2496-2509, Nov. 2007.*

(Continued)

*Primary Examiner* — Michael N Opsasnick
*Assistant Examiner* — Michael Ortiz Sanchez
(74) *Attorney, Agent, or Firm* — Staas & Halsey LLP

(57) ABSTRACT

Provided are a scalable wide-band speech coding/decoding apparatus, method, and medium. An input wide-band speech input signal is first divided into a low-band signal and a high-band signal. The divided low-band signal is then coded using a code excited linear prediction (CELP) method. The divided high-band signal is coded using a harmonic method. A signal representing a difference between a synthetic signal obtained from the low-band and the high band, and a signal input to the low-band and the high-band is then coded using a modified discrete cosine transform (MDCT) method. The coded signal is then multiplexed. The multiplexed signal is then output. Accordingly, high quality speech can be achieved for all layers.

32 Claims, 11 Drawing Sheets

U.S. PATENT DOCUMENTS

2002/0007280 A1* 1/2002 McCree ..... 704/500
2003/0187634 A1* 10/2003 Li ..... 704/200.1
2004/0111257 A1 6/2004 Sung et al.
2005/0004794 A1* 1/2005 Son et al. ..... 704/219
2005/0017879 A1* 1/2005 Linzmeier et al. ..... 341/50
2006/0149538 A1* 7/2006 Lee et al. ..... 704/219
2006/0277038 A1* 12/2006 Vos et al. ..... 704/219
2007/0088558 A1* 4/2007 Vos et al. ..... 704/275
2011/0280337 A1* 11/2011 Lee et al. ..... 375/295

OTHER PUBLICATIONS

Korean Notice of Allowance dated Apr. 30, 2012 corresponds to Korean Patent Application No. 10-2006-0049038.

* cited by examiner

SCALABLE SPEECH CODING/DECODING APPARATUS, METHOD, AND MEDIUM HAVING MIXED STRUCTURE

CROSS-REFERENCE TO RELATED APPLICATIONS

This application claims the benefit of U.S. Provisional Patent Application No. 60/701,502, filed on Jul. 22, 2005, in the U.S. Patent and Trademark Office, and Korean Patent Application No. 10-2006-0049038, filed on May 30, 2006, in the Korean Intellectual Property Office, the disclosures of which are incorporated herein in their entirety by reference.

BACKGROUND OF THE INVENTION

1. Field of the Invention

The present invention relates to speech coding/decoding, and more particularly, to an apparatus, method, and medium for reproducing a scalable wide-band speech signal.

2. Description of the Related Art

With the increased amount of speech communication applications in various fields, and an increase of network transmission speeds, there is an emerging demand for high fidelity speech communication. Accordingly, wide-band speech signals in the range of 0.05 kHz to 7 kHz, which show excellent capability in terms of naturalness and intelligibility in comparison with a known speech communication band ranging from 0.3 kHz to 3.4 kHz, are required to be transmitted.

In a packet switching network in which data is transmitted in unit of packets, a channel bottleneck may be caused, which may lead to packet loss and poor speech quality. Although a technique for hiding packet damage is known, this is not a satisfactory solution. Thus, a technique for scalable coding/decoding a wide-band speech signal has been proposed in which the wide-band speech signal can be effectively compressed, and the channel bottleneck can be reduced. Currently proposed methods of coding/decoding wide-band speech signals include a method in which speech signals in the range of 0.05 kHz to 7 kHz are simultaneously compressed and then restored, and a method in which speech signals are hierarchically compressed by being divided into signals in the range of 0.05 kHz to 4 kHz and signals in the range of 4 kHz to 7 kHz, and then restored. The latter method above is a wide-band speech coding/decoding method using a bandwidth scalability function for enabling optimum communication under the given channel condition by controlling the size of layers to be transmitted according to a data bottleneck condition. In the speech coding method using a bandwidth scalability function, a speech signal is coded and decoded using a hierarchical coding method. That is, the speech signal is coded after being divided into a core layer and a speech enhancement layer. The core layer transmits only information capable of restoring a minimum speech quality. The speech enhancement layer transmits additional information capable of enhancing speech quality. A method for providing a bandwidth scalability function in order to enhance speech quality is disclosed in U.S. Pat. No. 5,455,888, which is incorporated by reference in its entirety. FIG. 1 is a block diagram of a conventional bandwidth extension speech coding apparatus used in U.S. Pat. No. 5,455,888. FIG. 2 is a block diagram of a convention bandwidth extension speech coding apparatus used in U.S. Pat. No. 6,895,375, which is incorporated by reference in its entirety. In the conventional bandwidth extension speech coding apparatuses illustrated in FIGS. 1 and 2, information on a spectral shape and a power gain is used so that a power level is adjusted by using the power gain less than a spectral envelope that shows the spectral shape.

However, if a high-band speech signal is coded using conventional methods, the speech signal cannot be easily restored with high fidelity when the speech signal is transmitted at a low bit-rate. Further, the lower the bit-rate, the poorer the speech restoring capability. In addition, the conventional methods have not provided scalable wide-band speech reproduction for reducing/eliminating the channel bottleneck.

SUMMARY OF THE INVENTION

Additional aspects, features and/or advantages of the invention will be set forth in part in the description which follows and, in part, will be apparent from the description, or may be learned by practice of the invention.

The present invention provides an apparatus, method, and medium capable of reproducing a scalable wide-band speech signal, wherein, in scalable wide-band speech coding/decoding, a high quality speech signal is ensured for all layers by solving a problem that speech restoration capability deteriorates as a bit-rate decreases when a speech signal is transmitted in the process of coding a high-band speech signal.

The present invention also provides an apparatus, method, and medium for coding/decoding a wide-band speech, wherein, in a wide-band speech coding/decoding apparatus having a quality and bandwidth extension function, a bit required for extension has a scalable structure.

According to an aspect of the present invention, there is provided a scalable speech coding apparatus having a mixed structure, the apparatus comprising: a band divider dividing a speech input signal into a low-band signal and a high-band signal according to a specific frequency, and outputting the low-band signal and the high-band signal; a low-band coder outputting a low-band first index by coding the low-band signal, transmitting information required for coding the high-band signal to a high-band coder, and transmitting an uncoded first error signal to a wide-band coder; a high-band coder outputting a high-band second index obtained when the high-band signal is coded by using information received from the low-band coder, and transmitting an uncoded second error signal to the wide-band coder; a wide-band coder quantizing coefficients of the first and second error signals using a modified discrete cosine transform (MDCT) method through time-frequency mapping, and outputting a low-band third index; and a bit-stream generator outputting a scalable bit-stream composed of the low-band first index received from the low-band coder, the high-band second index received from the high-band coder, and the low-band third index received from the wide-band coder.

According to another aspect of the present invention, there is provided a scalable speech coding method having a mixed structure, the method comprising: (a) dividing a speech input signal into a low-band signal and a high-band signal according to a specific frequency, and outputting the low-band signal and the high-band signal; (b) generating and outputting a low-band first index by coding the output low-band signal, and outputting specific information required for coding the high-band signal and an uncoded first error signal; (c) coding the output high-band signal by using the specific information, and outputting a high-band second index and an uncoded second error signal; (d) quantizing coefficients of the first and second error signals using a modified discrete cosine transform (MDCT) through time-frequency mapping, and outputting a low-band third index; and (e) outputting a scalable bit-stream composed of the low-band first index, the high-band second index, and the low-band third index.

According to another aspect of the present invention, there is provided a computer-readable medium having embodied thereon a computer program for executing the above-described scalable speech coding method having a mixed structure.

According to another aspect of the present invention, there is provided a scalable speech decoding apparatus having a mixed structure, the apparatus comprising: a bit-stream divider receiving a scalable bit-stream transmitted at a specific transmission rate according to a network condition, and transmitting the scalable bit-stream to each decoder of a corresponding frequency band by dividing the scalable bit-stream according to a frequency band used in reproduction; a low-band decoder receiving a low-band signal into which the scalable bit-stream is divided by the bit-stream divider, decoding and outputting the decoded low-band signal, and transmitting specific information required for decoding a high-band signal among coefficients decoded in a low-band; a high-band decoder decoding and outputting the high-band signal into which the scalable bit-stream is divided by the bit-stream divider, by using the specific information; a wide-band decoder decoding a wide-band signal into which the scalable bitstream is divided by the bit-stream divider and dividing and outputting the decoded wide-band signal into a low-band signal and a high-band signal according to a specific frequency; and a band combiner outputting a wide-band synthetic signal of a combined band by receiving a first synthetic signal, which is generated when a signal output from the low-band decoder is combined with the low-band signal output from the wide-band decoder, and a second synthetic signal which is generated when a signal output from the high-band decoder is combined with the high-band signal output from the wide-band decoder.

According to another aspect of the present invention, there is provided a scalable speech decoding method having a mixed structure, the method comprising: (a) receiving a scalable bit-stream transmitted at a specific transmission rate according to a network condition, and dividing and outputting the scalable bit-stream into a low-band signal, a high-band signal, and a wide-band signal according to a frequency band used for reproduction; (b) decoding and outputting the low-band signal of the scalable bitstream and outputting information on a pitch signal among coefficients decoded in a low-band; (c) receiving the high-band signal of the scalable bitstream and the pitch signal information and decoding and outputting the high-band signal using the pitch signal information; (d) receiving and decoding the wide-band signal of the scalable bitstream and dividing and outputting the decoded wide-band signal into a low-band signal and a high-band signal according to a specific frequency; and (e) outputting a wide-band synthetic signal of a combined band by receiving a first synthetic signal, which is generated when a signal output in (b) is combined with a low-band signal output in (d), and a second synthetic signal which is generated when a signal output in (c) is combined with a high-band signal output in (d).

According to another aspect of the present invention, there is provided a computer-readable medium having embodied thereon a computer program for executing the above-described scalable speech decoding method having a mixed structure.

BRIEF DESCRIPTION OF THE DRAWINGS

These and/or other aspects, features, and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
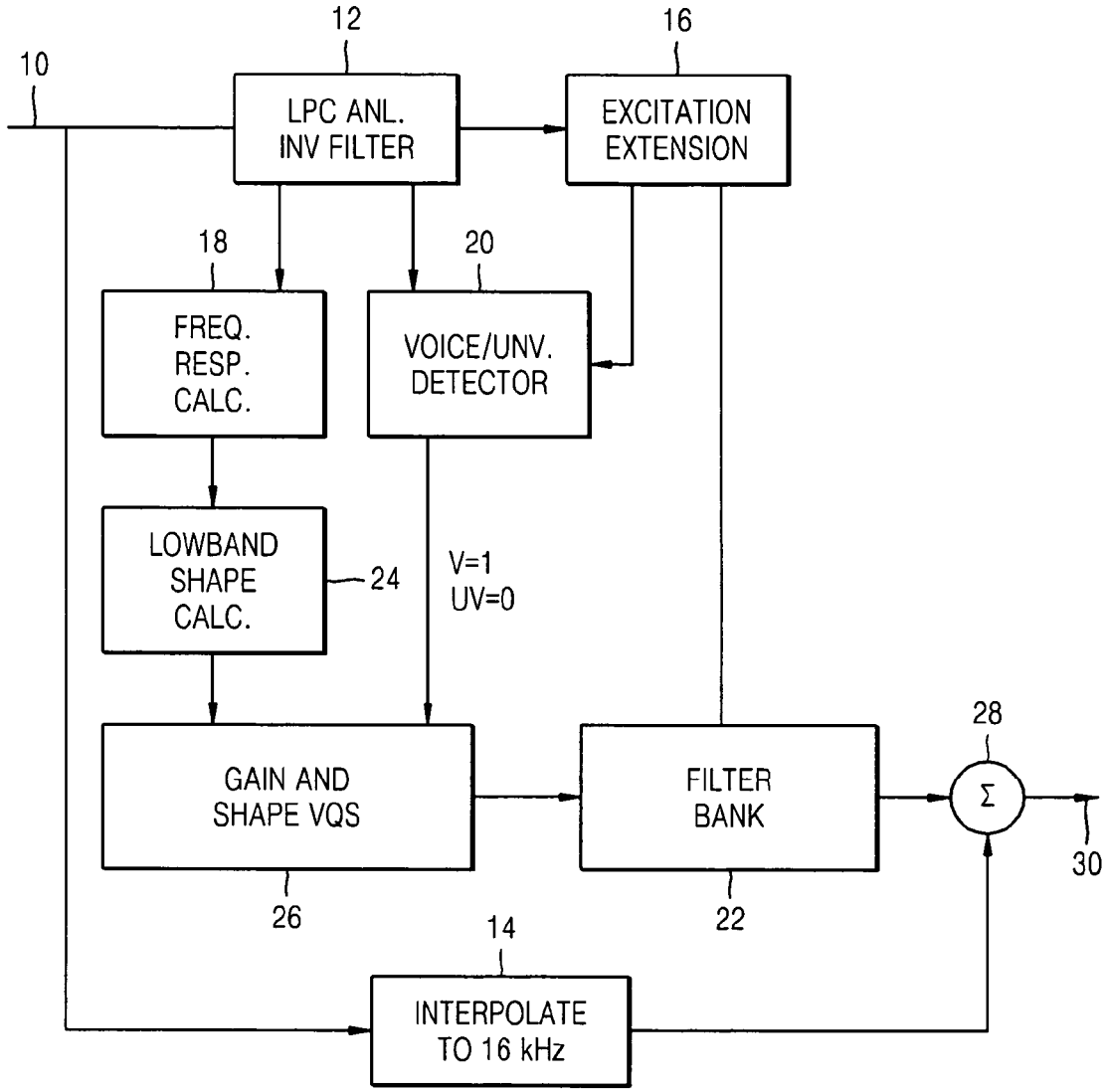
FIG. 1 (PRIOR ART)
FIG. 1 is a block diagram of a conventional bandwidth extension speech coding apparatus (U.S. Pat. No. 5,455,888)
Figure 2:
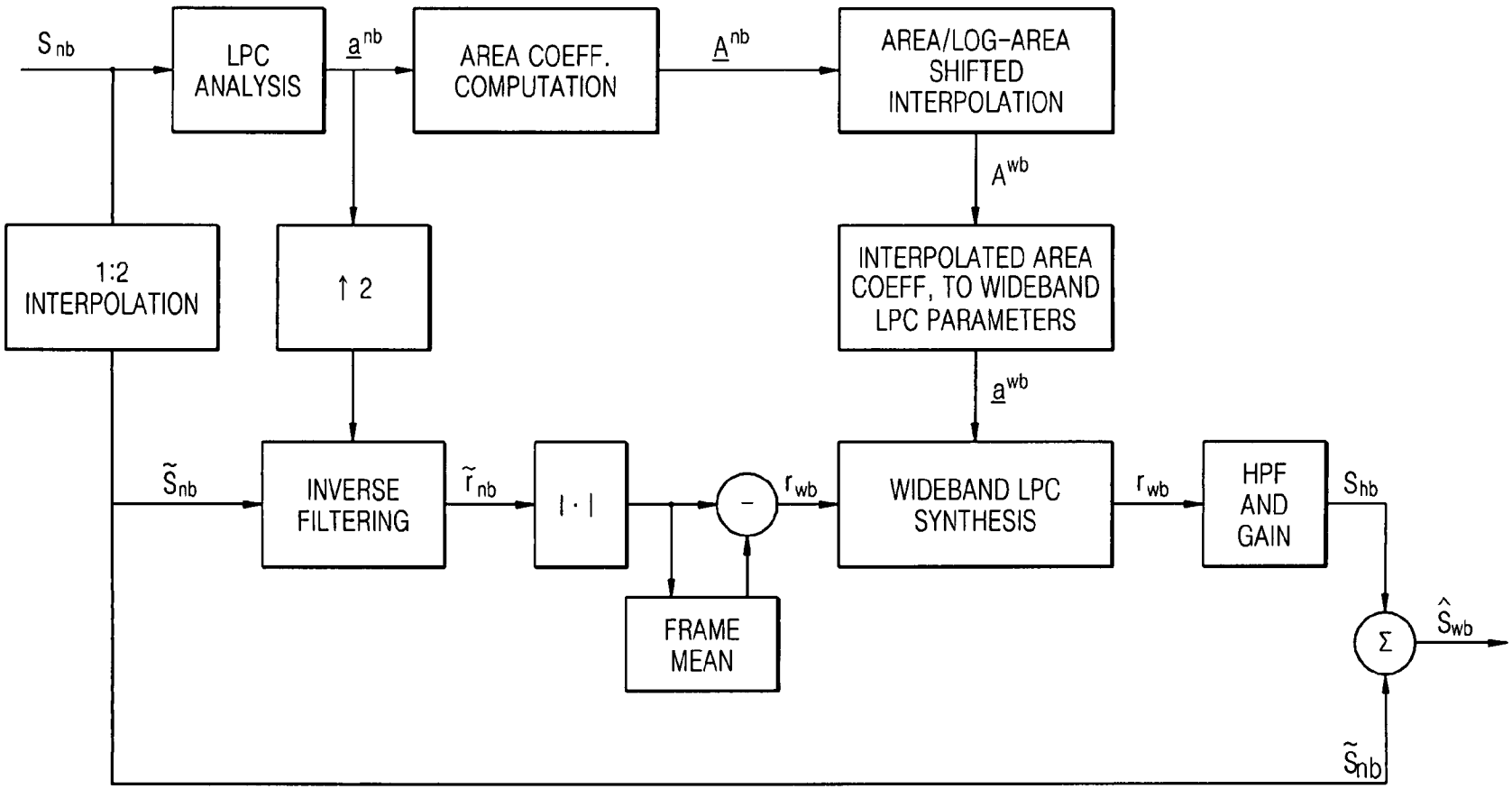
FIG. 2 (PRIOR ART)
FIG. 2 is a block diagram of a convention bandwidth extension speech coding apparatus (U.S. Pat. No. 6,895,375)

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Figure 3:
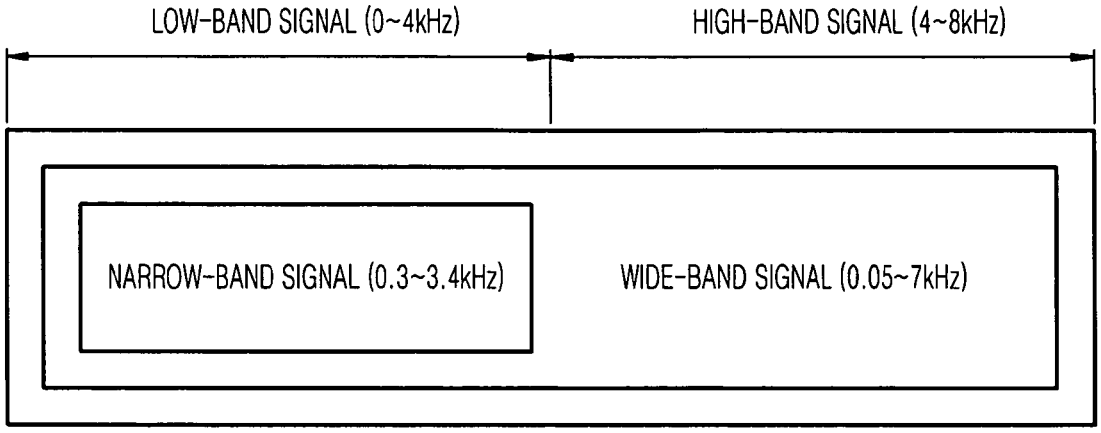
FIG. 3 is a diagram defining terminologies of various signals according to an exemplary embodiment of the present invention.

FIG. 3 is a diagram defining terminologies of various signals according to an exemplary embodiment of the present invention. An input signal, which is sampled at 16 kHz and has a frequency component in the range of 0~8 kHz, can be divided into a low-band signal in the range of 0~4 kHz, and a high-band signal in the range of 4~8 kHz. However, this is only an ideal division. In practice, speech coding is performed by dividing the input signal into a narrow-band signal and a wide-band signal. The narrow-band signal is defined as a signal in the range of 0.3~3.4 kHz, and the wide-band signal is defined as a signal in the range of 0.05 ~7 kHz.

Figure 4:
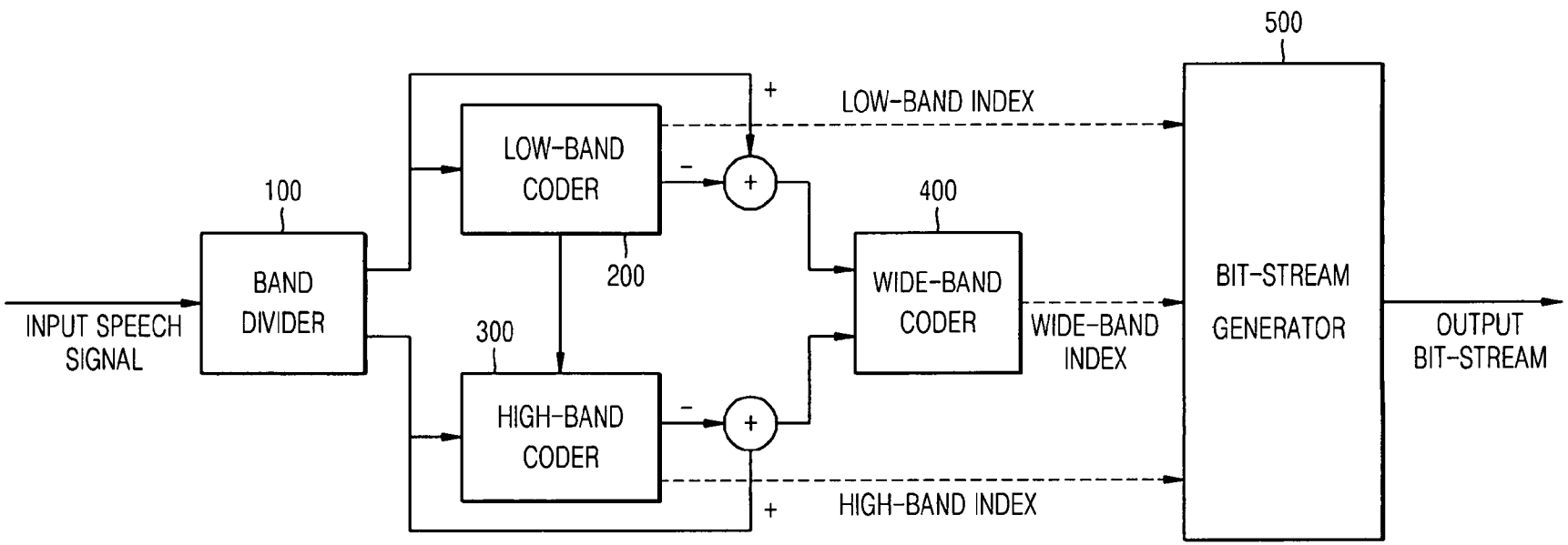
FIG. 4 illustrates a configuration of a scalable speech coding apparatus having a mixed structure according to an exemplary embodiment of the present invention.

FIG. 4 illustrates a configuration of a scalable speech coding apparatus having a mixed structure according to an exemplary embodiment of the present invention.

Referring to FIG. 4, the speech coding apparatus includes a band divider 100, a low-band coder 200, a high-band coder 300, a wide-band coder 400, and a bit-stream generator 500.

Figure 10:
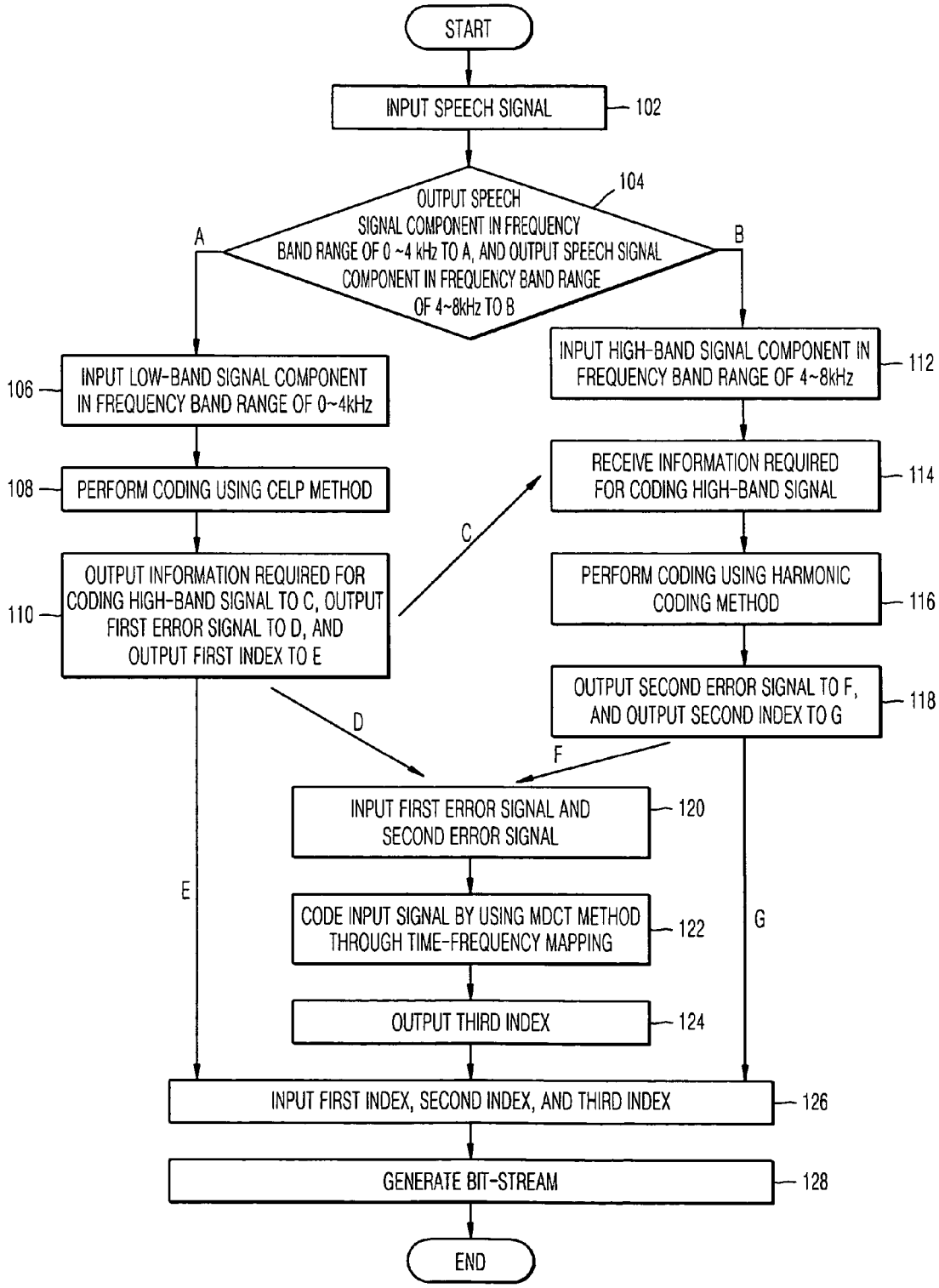
FIG. 10 is a flowchart illustrating a coding process performed in a scalable speech coding apparatus having a mixed structure according to an exemplary embodiment of the present invention.

FIG. 10 is a flowchart illustrating a coding process performed in a scalable speech coding apparatus having a mixed structure according to an exemplary embodiment of the present invention.

In operation 102, the speech coding apparatus according to an exemplary embodiment of the present invention illustrated in FIG. 4 receives a wide-band speech signal of 0~8 kHz sampled at 16 kHz through the band divider 100.

In operation 104, the band divider 100 classifies the wide-band speech signal received in operation 102 into a low-band signal in the frequency range of 0~4 kHz, and a high-band signal in the frequency range of 4~8 kHz by using a reference frequency, for example 4 kHz. Then the band divider 100 outputs the low-band signal to the low-band coder 200 (A in FIG. 10), and outputs the high-band signal to the high-band coder 300 (B in FIG. 10).

In operation 106, the low-band coder 200 receives a low-band signal component in the frequency range of 0~4 kHz.

In operation 108, the low-band coder 200 codes the received low-band signal component using a code excited linear prediction (CELP) method.

Now, a process of coding the received low-band signal by using the CELP method will be described with reference to FIG. 7.

Figure 7:
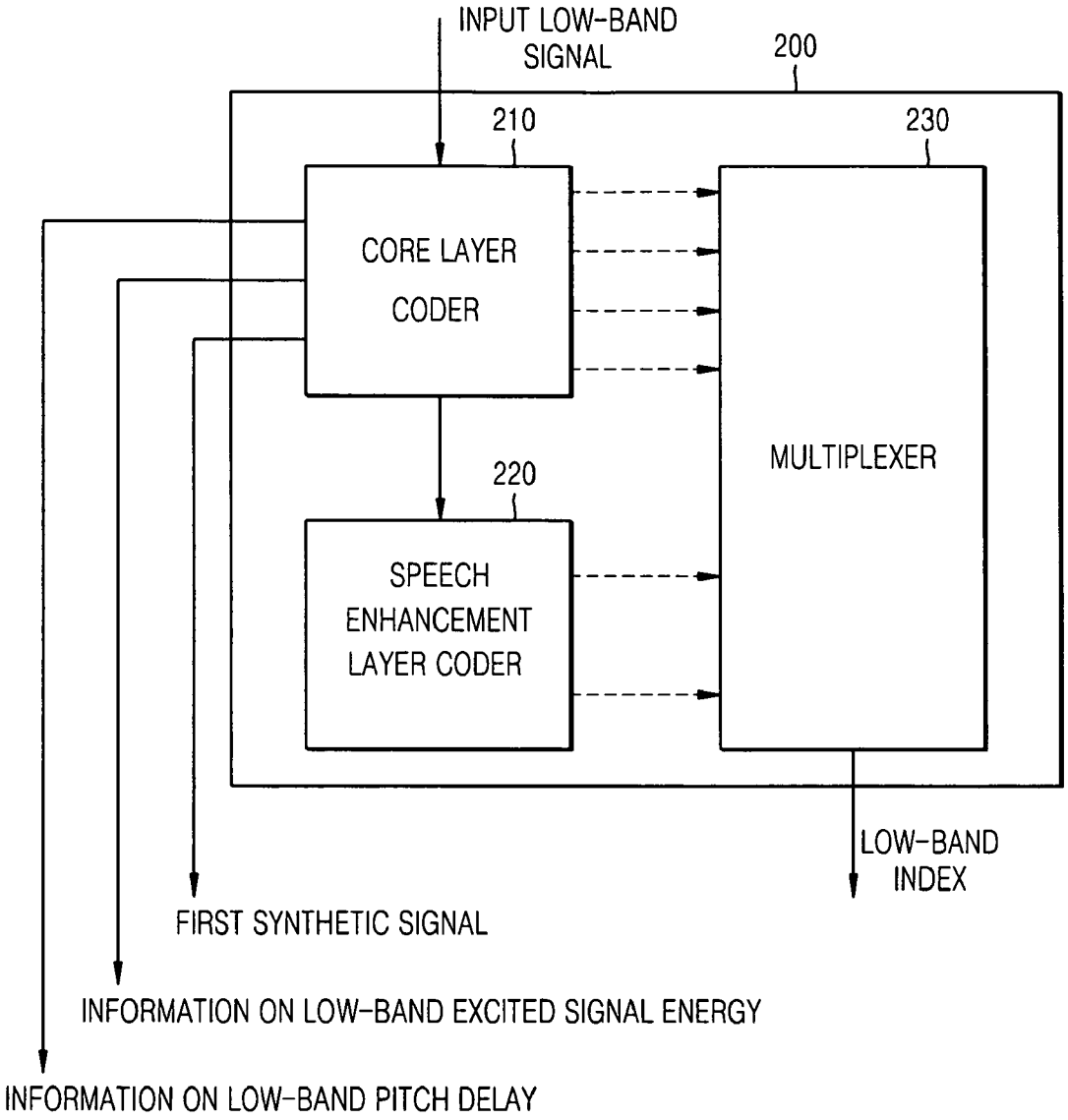
FIG. 7 illustrates an internal configuration of a low-band coder of the scalable speech coding apparatus having a mixed structure of FIG. 4, according to an exemplary embodiment of the present invention.

FIG. 7 illustrates an internal configuration of the low-band coder 200 of the scalable speech coding apparatus having a mixed structure of FIG. 4, according to an exemplary embodiment of the present invention.

The low-band coder 200 includes a core layer coder 210, a speech enhancement layer coder 220, and a multiplexer 230.

Now, a process of coding a low-band signal received from the low-band coder 200 of FIG. 4 will be described with reference to FIGS. 7 and 10.

In operation 110, the core layer coder 210 performs quantization after a linear prediction analyzer/quantizer (not shown) obtains a linear prediction coefficient, and transmits the quantized linear prediction coefficient to the multiplexer 230. An excited signal generated by using the quantized linear prediction coefficient is passed through a synthetic filter (not shown), thereby generating a first synthetic signal included in the core layer. The speech enhancement layer coder 220 also generates a first synthetic signal included in the speech enhancement layer corresponding to the first synthetic signal included in the core layer. The first synthetic signal included in the core layer and the first synthetic signal included in the speech enhancement layer are combined to generate a first synthetic signal. A difference between the low-band signal input to the low-band coder 200 and the first synthetic signal output from the low-band coder 200 is defined as a first error signal. The first error signal is transmitted to the wide-band coder 400 of FIG. 4.

A perceptual weighting filter (not shown) performs perceptual weighting linear prediction by using the quantized linear prediction coefficient. A pitch analyzer (not shown) searches for a pitch by using a prediction signal output from the perceptual weighting filter. A contribution factor for the pitch of a signal passing through the perceptual weighting filter is removed by using the found pitch, and a signal which has to be searched for in a fixed codebook is obtained. The signal obtained from the fixed codebook is transmitted to the low-band coder 200. The core layer coder 210 obtains an index and gain of an adaptive codebook as well as an index and gain of the fixed codebook by using an analysis-by-synthesis method. Further, the core layer coder 210 quantizes gain values of the adaptive codebook and the fixed codebook, and transmits information on the quantized gain value of the fixed codebook to the speech enhancement layer coder 220. The core layer coder 210 transmits to the multiplexer 230 information obtained by quantizing the fixed codebook index, the adaptive codebook index and gain value in addition to the quantized linear prediction coefficient.

The speech enhancement layer coder 220 generates a fixed codebook index and quantization information on a gain value difference included in the speech enhancement layer by using the signal obtained from a fixed codebook and which is received from the core layer coder 210 and information on a quantized gain value of the fixed codebook, and then transmits the generated information to the multiplexer 230.

The low-band coder 200 outputs information on low-band pitch delay generated by decoding the adaptive codebook index to the high-band coder 300. Further, the low-band coder 200 generates low-band excited signal energy by integrating quantized values of the adaptive codebook index and gain included in the core layer, the fixed codebook index and gain included in the core layer, the fixed codebook index included in the speech enhancement layer, and the gain value included in the speech enhancement layer, and then outputs the result to the high-band coder 300.

The multiplexer 230 outputs a low-band index indicating a low-band by using information received from the core layer coder 210, such as linear prediction coefficient quantization information, information on low-band pitch delay, an adaptive codebook index, gain value quantization information, and by using information received from the speech enhancement layer coder 220, such as the fixed codebook index included in the speech enhancement layer, and gain value difference quantization information. Referring back to FIG. 10, the high-band coder 300 receives a high-band signal component in the frequency range of 4 ~8 k Hz in operation 112.

In operation 114, the high-band coder 300 receives information required for coding a high-band signal received from the low-band coder 200.

When a harmonic method is used as a coding method according to an exemplary embodiment of the present invention, examples of information required for coding a high-band signal include information on low-band pitch delay and information on low-band excited signal energy. In operation 116, the high-band coder 300 codes the received high-band signal by using the low-band pitch delay information and the low-band excited signal energy information received from the low-band coder 200.

Figure 8:
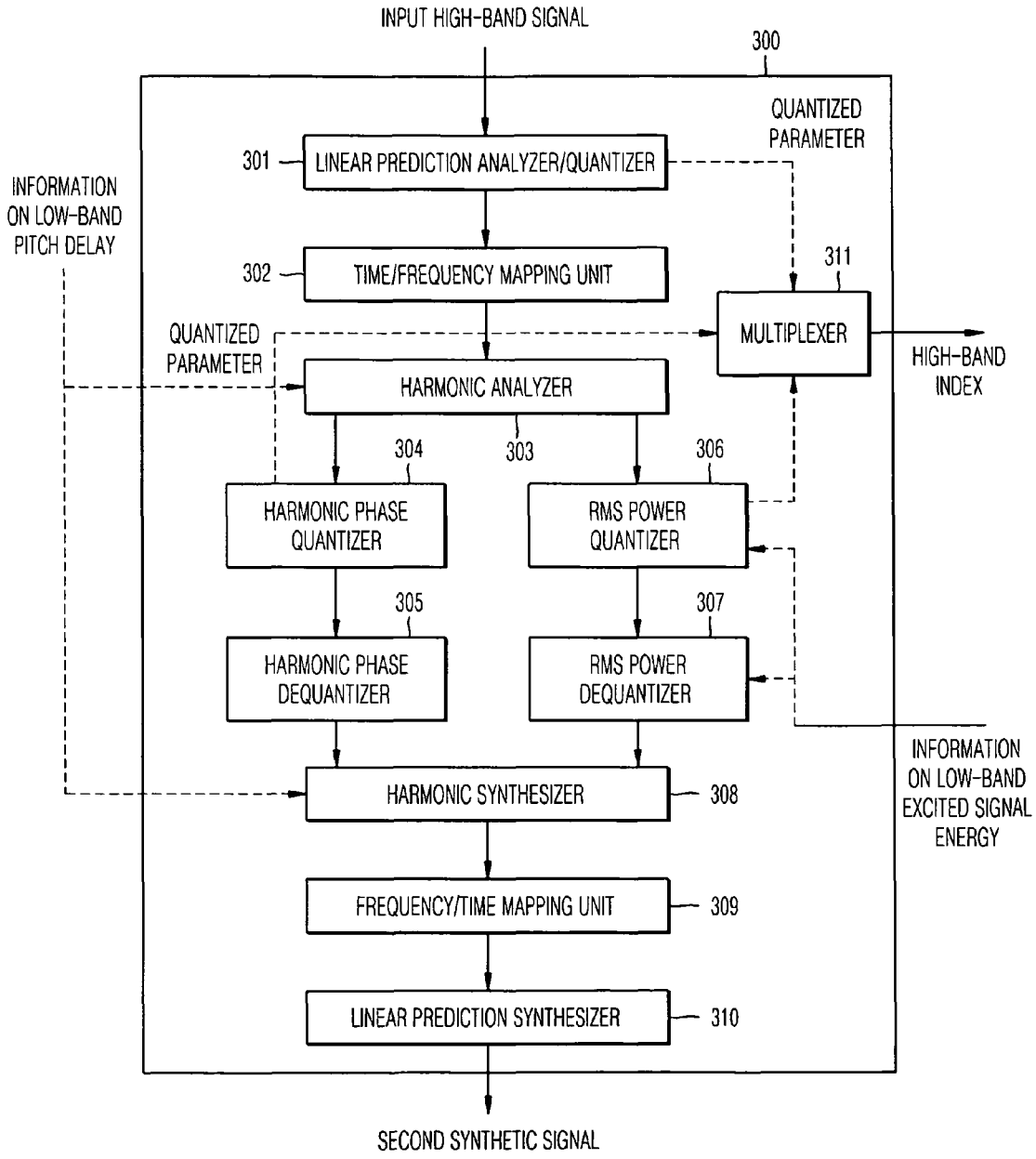
FIG. 8 illustrates an internal configuration of a high-band coder included in the scalable speech coding apparatus having a mixed structure of FIG. 4, according to an exemplary embodiment of the present invention.

Now, a coding process using a harmonic method will be described with reference to FIG. 8. FIG. 8 illustrates an internal configuration of the high-band coder 300 included in the scalable speech coding apparatus having a mixed structure of FIG. 4, according to an exemplary embodiment of the present invention The high-band coder 300 includes a linear prediction analyzer/quantizer 301, a time/frequency mapping unit 302, a harmonic analyzer 303, a harmonic phase quantizer 304, and an RMS power quantizer 306, each of which has a coding function. Further, the high-band coder 300 includes a harmonic phase dequantizer 305, an RMS power dequantizer 307, a harmonic synthesizer 308, a frequency/time mapping unit 309, a linear prediction synthesizer 310, and a multiplexer 311, each of which has a decoding function.

The linear prediction analyzer/quantizer 301 obtains a linear prediction coding coefficient using a general code excited linear prediction (CELP) method by using a high-band input signal received from a quadrature mirror filter (QMF), and then quantizes the coefficient. The quantized coefficient is output and transmitted to the multiplexer 311. The linear prediction analyzer/quantizer 301 performs linear prediction by using the quantized coefficient. Since the linear prediction coding is represented by parameters, a residual signal may be generated in the case of not being able to be represented by the parameters. The generated residual signal is transmitted to the time/frequency mapping unit 302. The time/frequency mapping unit 302 obtains amplitudes and phases of an input residual signal with respect to each frequency component. The amplitudes and phases for each frequency component obtained by the time/frequency mapping unit 302 are transmitted to the harmonic analyzer 303. The harmonic analyzer 303 searches for a harmonic position by using the amplitudes and phases for each frequency component received from the time/frequency mapping unit 302 and information on low-band pitch delay received from the low-band coder 200. Then, frequency information associated with the found harmonic position is coded. A pitch may differ according to features of an actual input speech signal, and in this case, the number of harmonics may vary. Thus, only some harmonics may be quantized. For this reason, in order to code frequency information associated with a harmonic position with a limited transmission rate, a signal associated with an important harmonic position has to be determined. The harmonic analyzer 303 selects the signal associated with an important harmonic position. The signal associated with an important harmonic position may contain a value of a harmonic component located in a relatively low frequency band, a value of a harmonic component having a relatively large energy magnitude over the entire frequency band, or a value of a harmonic component associated with a Formant frequency position when restored by using the linear prediction coding coefficient. Once a harmonic component to be coded by the harmonic analyzer 303 is determined, phase information associated with each harmonic position is extracted, and the extracted harmonic phase information is quantized by the harmonic phase quantizer 304. The harmonic phase quantizer 304 quantizes each harmonic phase obtained as above. When quantizing, various quantization methods may be used such as scalar quantization (SQ) or vector quantization (VQ).

In addition, the harmonic analyzer 303 obtains a high-band root mean square (RMS) power. When various scalability factors are given, a gain is not necessarily required for each layer due to the high-band RMS power. That is, a speech signal is synthesized by using the signal associated with an important harmonic position and the linear prediction coding coefficient, and then is scaled as much as by a high-band energy magnitude. The obtained high-band RMS power is quantized by the RMS power quantizer 306. In order to code the high-band RMS power further effectively, the RMS power quantizer 306 uses statistic information coded in the low-band. According to an exemplary embodiment of the present invention, energy information on a low-band excited signal received from the low-band coder 200 is used. Quantization can be further effectively achieved when the ratio of the low-band excited signal energy and the high-band RMS power is quantized.

Although coding is completed as described above, since a high-band portion is one sub-module of a coder/decoder (CODEC), an output signal can be synthesized only when a decoding module is included in a high-band coding module after coding is completed. Therefore, a decoding process is required as follows.

The harmonic phase dequantizer 305 dequantizes a phase by using a quantized parameter, and transmits the dequantized phase to the harmonic synthesizer 308. The RMS power dequantizer 307 obtains an RMS power that is quantized by inversely applying a quantization process performed by the RMS power quantizer 306 by utilizing the information on low-band excited signal energy received from the low-band coder 200, and transmits this value to the harmonic synthesizer 308. The harmonic synthesizer 308 synthesizes a harmonic component by using the transmitted value, predetermined harmonic position information, and the number of harmonics to be restored. Information on phase of frequency and amplitude of frequency does not seem right is obtained by using the synthesized harmonic information.

The information on the phase and amplitude of frequency is transformed into a time-domain signal by the frequency/time mapping unit 309. The transformed signal becomes an excited signal of the linear prediction synthesizer 310. The linear prediction synthesizer 310 passes the excited signal through a synthetic filter, and outputs a finally synthesized second synthetic signal. A signal representing a difference based on the second synthetic signal output from the high-band signal which has been input to the high-band coder 300 is transmitted to the wide-band coder 400 as a second error signal.

Referring back to FIG. 10, the wide-band coder 400 receives a first error signal from the low-band coder 200, and receives a second error signal from the high-band coder 300 in operation 120.

In operation 122, the wide-band coder 400 codes the received first and second error signals by using a modified discrete cosine transform (MDCT) method through time/frequency mapping.

Now, a coding process using the MDCT method will be described with reference to FIG. 9.

Figure 9:
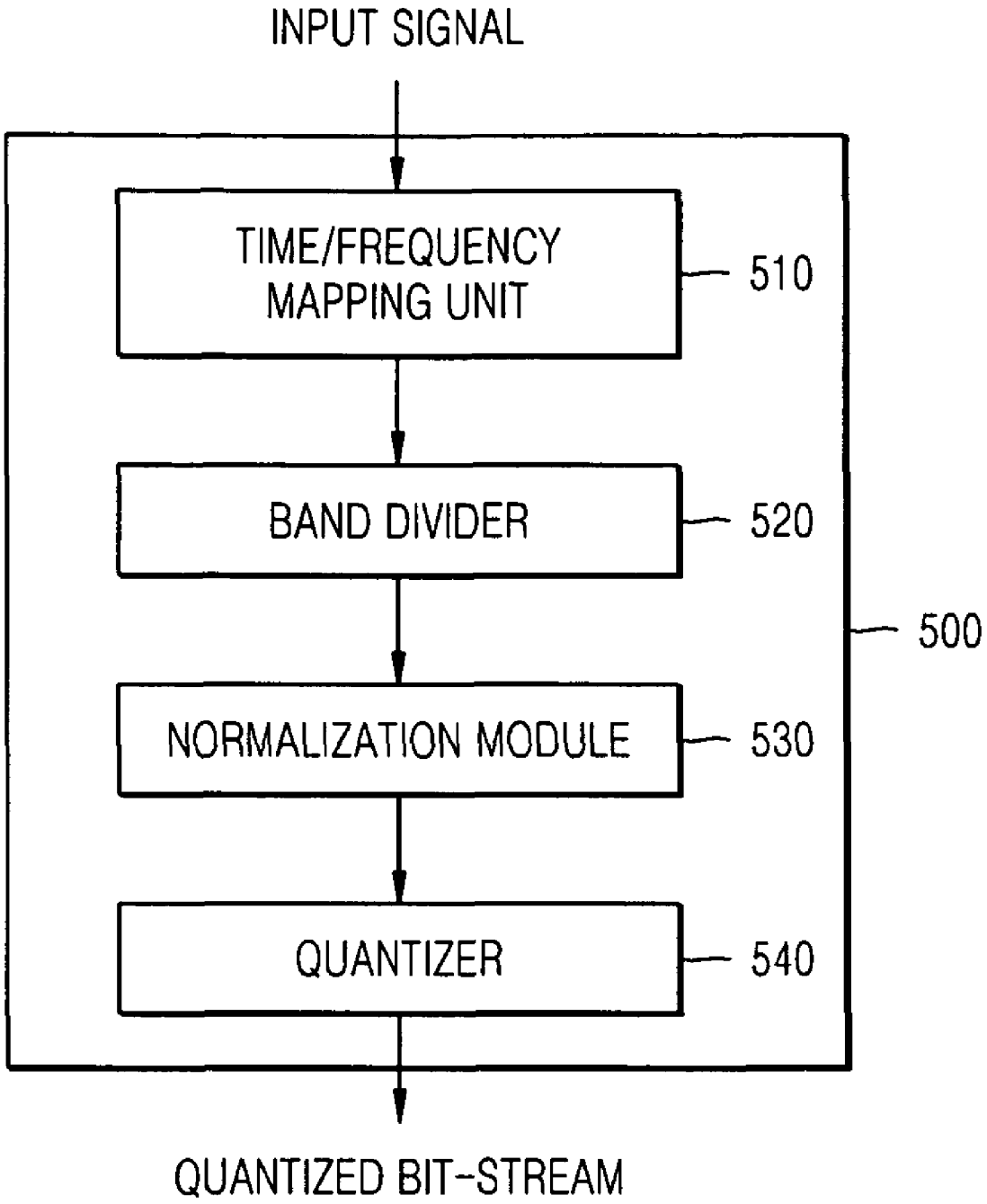
FIG. 9 illustrates an internal configuration of a wide-band coder of the scalable speech coding apparatus having a mixed structure of FIG. 4, according to an exemplary embodiment of the present invention.

FIG. 9 illustrates an internal configuration of the wide-band coder 500 of the scalable speech coding apparatus having a mixed structure of FIG. 4, according to an exemplary embodiment of the present invention.

The wide-band coder 500 includes a time/frequency mapping unit 510, a band divider 520, a normalization module 530, and a quantizer 540.

First and second error signals, that is, time-domain input signals of the wide-band coder 500, are first input to the time/frequency mapping unit 510. In the input first and second error signals, a low-band signal is first subjected to the MDCT through time-frequency mapping. Thereafter, a high-band signal is subjected to the MDCT through time-frequency mapping. Transformed coefficients are sequentially integrated in the order of low-band to high-band, thereby obtaining a wide-band signal. The wide-band signal is processed by the band divider 520 after being divided for each band. A band may be partitioned using various methods. For example, a band may be partitioned into uniformly spaced sections. In addition, by taking a human auditory model into account, a low-band may be narrowly partitioned, and a high-band may be widely partitioned.

The normalization module 530 classifies a signal of which a band is divided by the band divider 520 into power of band and a normalized coefficient for each band. Preferably, an RMS power of each band may be first obtained, and normalized coefficients may be then obtained by dividing all coefficients by the RMS power. The normalized coefficients are quantized by the quantizer 540.

Referring back to FIG. 10, in operation 126, the bit-stream generator 500 receives a first index from the low-band coder 200, receives a second index from the high-band coder 300, and receives a third index from the wide-band coder 400.

In operation 128, the bit-stream generator 500 combines the received first, second, and third indexes so as to generate a bit-stream, and then outputs the bit-stream.

Figure 5:
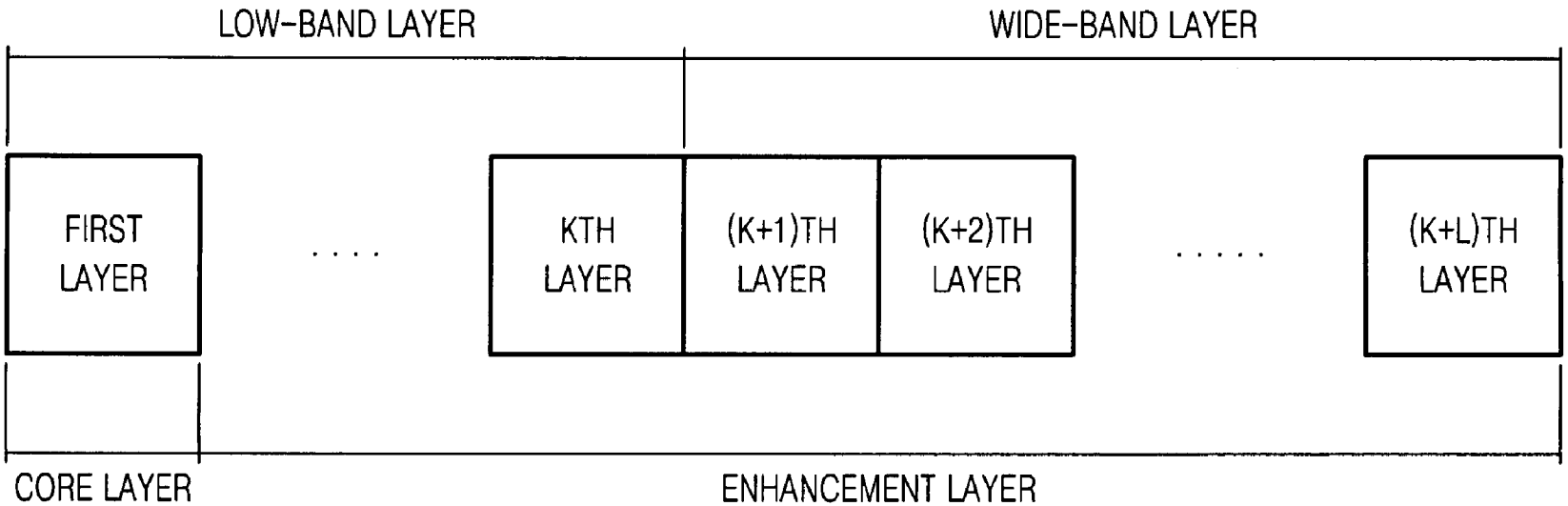
FIG. 5 illustrates a configuration of a scalable bit-stream output from a bit-stream generator according to an exemplary embodiment of the present invention.

FIG. 5 illustrates a configuration of a scalable bit-stream output from the bit-stream generator of FIG. 4 according to an exemplary embodiment of the present invention.

The bit-stream is constructed in the order of a low-band layer coded by the low-band coder 200 having a CELP structure, a high-band layer coded by the high-band coder 300 having a harmonic structure, and a wide-band layer coded by the wide-band coder 400 having an MDCT structure. Further, the bit-stream can be divided into one core layer, which is not optional, and a plurality of enhancement layers. Whenever the enhancement layers are added to the core layer, speech quality is improved, or bandwidth increases. Moreover, the bit-stream may be divided into narrow-band information and wide-band information. The narrow-band information is obtained from a low-band. K layers can be constructed in a scalable manner by using the narrow-band information. The wide-band information includes high-band information and wide-band information. L layers can be constructed by using the wide-band information. Therefore, according to an exemplary embodiment of the present invention, the number of bit-stream layers is K+L.

Figure 6:
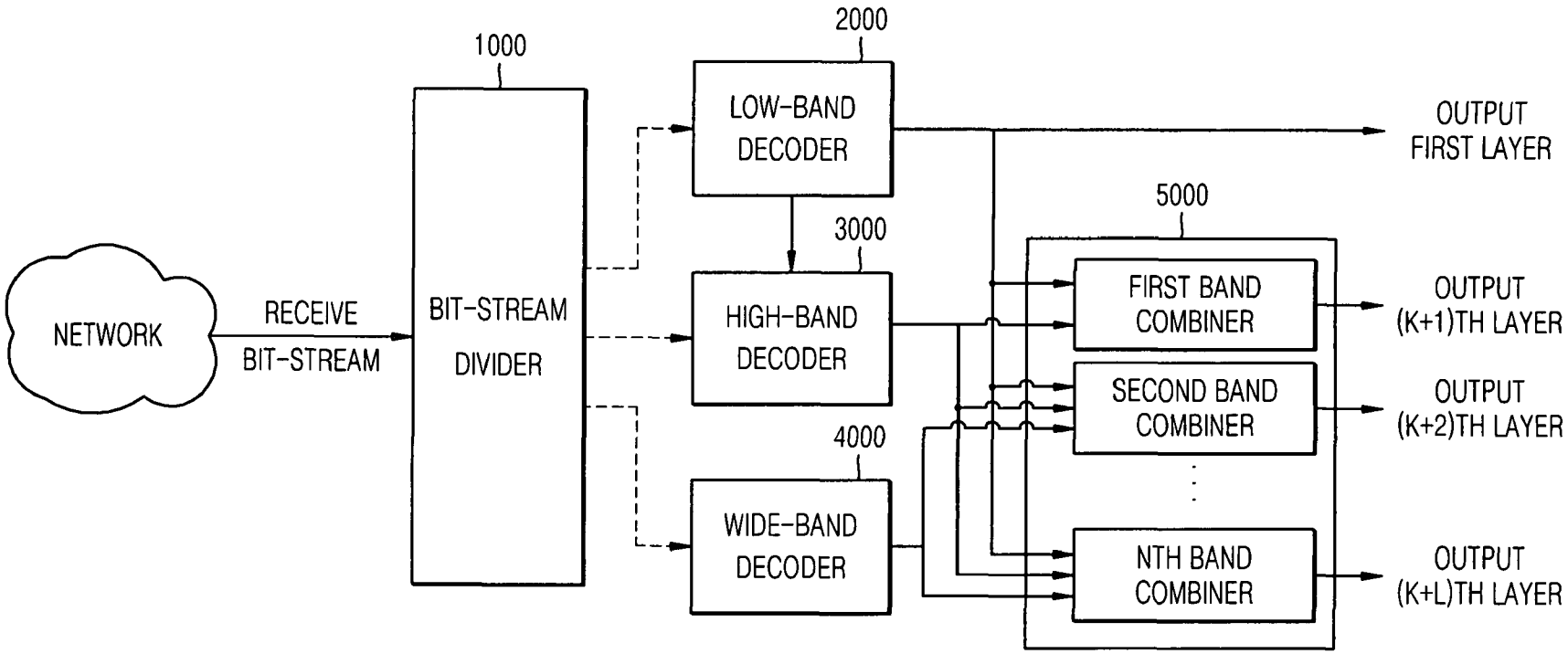
FIG. 6 illustrates a scalable speech decoding apparatus having a mixed structure according to an exemplary embodiment of the present invention.

FIG. 6 illustrates a scalable speech decoding apparatus having a mixed structure according to an exemplary embodiment of the present invention.

Referring to FIG. 6, the scalable speech decoding apparatus includes a bit-stream divider 1000, a low-band decoder 2000, a high-band decoder 3000, a wide-band decoder 4000, and a band combiner 5000.

Figure 11:
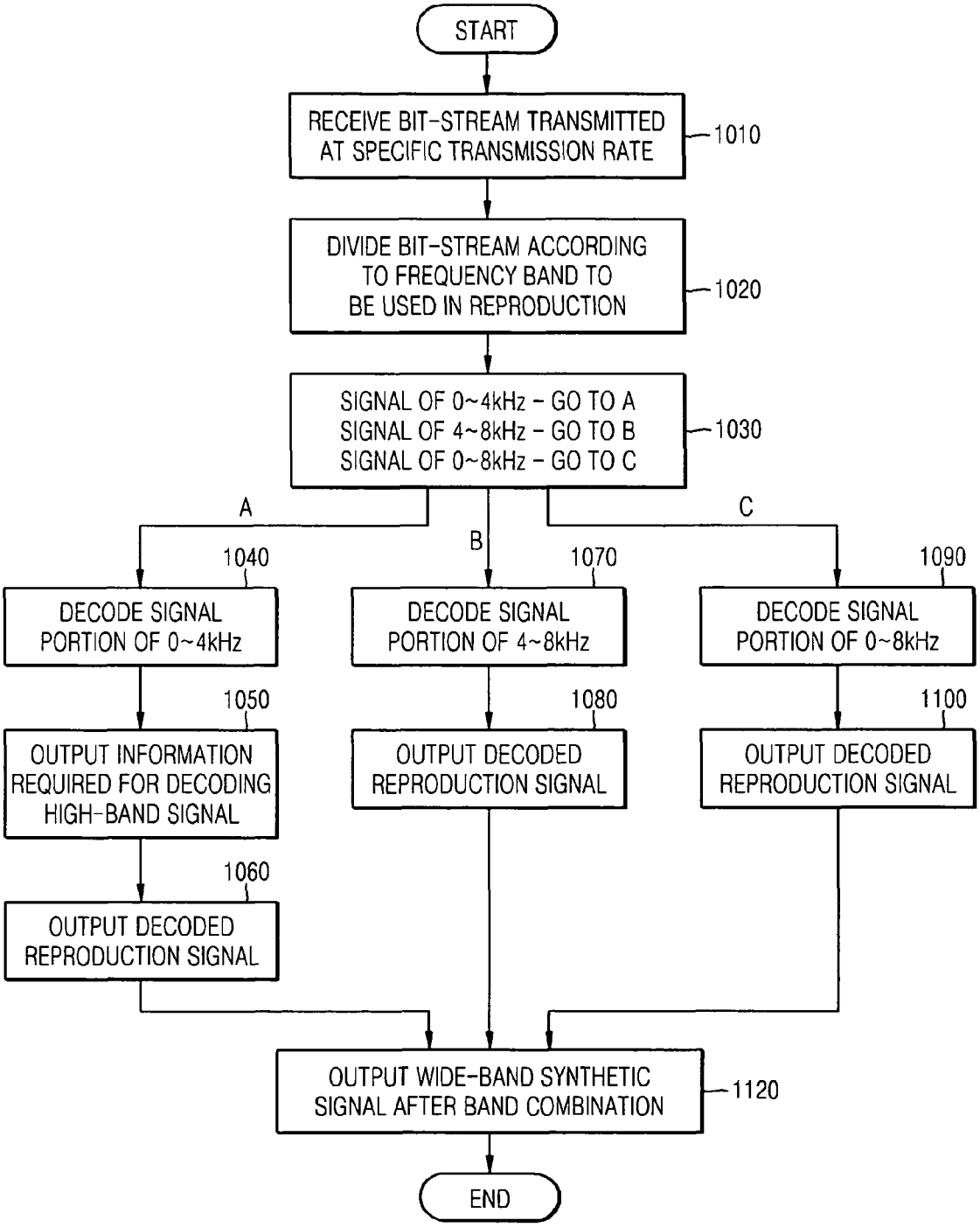
FIG. 11 is a flowchart illustrating a decoding process performed by a scalable speech decoding apparatus having a mixed structure according to an exemplary embodiment of the present invention.

FIG. 11 is a flowchart illustrating a decoding process performed by the scalable speech decoding apparatus having a mixed structure of FIG. 6, according to an exemplary embodiment of the present invention.

In operation 1010, the bit-stream divider 1000 receives a bit-stream transmitted at a specific transmission rate according to a network environment.

In operation 1020, the bit-stream divider 1000 disassembles the received bit-stream according to a desired syntax. When disassembled, a corresponding portion of the bit-stream is divided according to whether a frequency band to be used in reproduction is a low-band (0~4 kHz), or a wide-band (0~8 kHz) including a high-band (4~8 kHz).

In operation 1030, the bit-stream divider 1000 outputs the bit-stream divided according to a frequency band to each band decoder.

A low-band signal (0~4 kHz) is output to the low-band decoder 2000. A high-band signal (4~8 kHz) is output to the high-band decoder 3000. A wide-band signal (0~8 kHz) is output to the wide-band decoder 4000.

In operation 1040, the low-band decoder 2000 decodes a signal portion of the low-band (0~4 kHz) included in the divided bit-stream.

In operation 1050, the low-band decoder 2000 outputs information required for decoding a high-band signal among coefficients decoded in a low-band, and transmits the information to the high-band decoder 3000. The information required for decoding a high-band signal includes pitch information.

In operation 1060, the low-band decoder 2000 outputs a reproduction signal decoded in operation 1040, and transmits the reproduction signal to the band combiner 5000.

In operation 1070, the high-band decoder 3000 decodes a signal portion of a high-band (4~8 kHz) included in the divided bit-stream. In this operation, the high-band decoder 3000 obtains a harmonic position by using a pitch signal received from the low-band decoder 2000, and uses a harmonic method in which a high-band signal is decoded by using information associated with the obtained harmonic position.

In operation 1080, the high-band decoder 3000 outputs the reproduction signal decoded in operation 1070, and transmits the regenerated signal to the band combiner 5000.

In operation 1090, the wide-band decoder 4000 decodes a signal portion of a wide-band (0~8 kHz) included in the divided bit-stream.

In operation 1100, the wide-band decoder 4000 divides the decoded reproduction signal into a low-band signal and a high-band signal, and then transmits the divided signals.

Referring back to FIG. 6, signals output from the low-band decoder 2000, the high-band decoder 3000, and the wide-band decoder 4000 are combined according to respective bands, and are transmitted to the band combiner 5000.

In operation 1120, the band combiner 5000 combines signals received from the low-band decoder 2000, the high-band decoder 3000, and the wide-band decoder 4000, and then outputs the combined signals included in corresponding layers. A signal output to a (K+1)th layer is composed of only signals output from the low-band decoder 2000 and the high-band decoder 3000. Signals output to a (K+2)th layer through a (K+L)th layer are output after all signals output from the low-band decoder 2000, the high-band decoder 3000, and the wide-band decoder 4000 are combined.

According to the present invention, scalable speech service can be achieved, and a high-band signal can be effectively compressed using a bandwidth extension method. Further, the present invention can be easily applied in combination with a conventional speech coding method for a narrow-band signal. Since a code excited linear prediction (CELP) structure is used as a low-band coding method, excellent speech quality can be provided at a low bit-rate of a speech signal. A signal output from a high-band coder is combined with a low-band signal, so that a speech signal can be output with high fidelity at a low transmission rate. Since a wide-band output signal also can be combined therewith, not only a speech signal can be output as close as the original speech signal, but also a music signal can be reproduced.

In addition to the above-described exemplary embodiments, exemplary embodiments of the present invention can also be implemented by executing computer readable code/instructions in/on a medium/media, e.g., a computer readable medium/media. The medium/media can correspond to any medium/media permitting the storing and/or transmission of the computer readable code/instructions. The medium/media may also include, alone or in combination with the computer readable code/instructions, data files, data structures, and the like. Examples of computer readable code/instructions include both machine code, such as produced by a compiler, and files containing higher level code that may be executed by a computing device and the like using an interpreter. The computer readable code/instructions can be recorded/transferred in/on a medium/media in a variety of ways, with examples of the medium/media including magnetic storage media (e.g., floppy disks, hard disks, magnetic tapes, etc.), optical media (e.g., CD-ROMs, or DVDs), magneto-optical media (e.g., floptical disks), hardware storage devices (e.g., read only memory media, random access memory media, flash memories, etc.) and storage/transmission media such as carrier waves transmitting signals, which may include computer readable code/instructions, data files, data structures, etc. Examples of storage/transmission media may include wired and/or wireless transmission (such as transmission through the Internet). For example, wired storage/transmission media may include optical wires/lines, waveguides, and metallic wires/lines including a carrier wave transmitting signals specifying program instructions, data structures, data files, etc. The medium/media may also be a distributed network, so that the computer readable code/instructions is stored/transferred and executed in a distributed fashion. The medium/media may also be the Internet. The computer readable code/instructions may be executed by one or more processors. In addition, the above hardware devices may be configured to act as one or more software modules in order to perform the operations of the above-described exemplary embodiments.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. A scalable speech coding apparatus having a mixed structure, the apparatus comprising:

a band divider to divide a speech input signal into a low-band signal and a high-band signal according to a specific frequency, and outputting the low-band signal and the high-band signal;

a low-band coder to output a low-band first index by coding the low-band signal, to transmit information required for coding the high-band signal to a high-band coder, and to transmit a error signal obtained from the low-band signal and a signal generated during coding the low-band signal;

a high-band coder to output a high-band second index obtained when the high-band signal is coded by using information received from the low-band coder, and to transmit a second error signal obtained from the high-band signal and a signal generated during coding the high-band signal;

a wide-band coder to obtain a wide-band third index from the first and second error signals using a modified discrete cosine transform (MDCT); and a bit-stream generator to output a scalable bit-stream composed of the low-band first index received from the low-band coder, the high-band second index received from the high-band coder, and the wide-band third index received from the wide-band coder.

2. The apparatus of claim 1, wherein the bit-stream is combined with narrow-band information composed of one or more layers obtained by using the low-band first index, and wide-band information composed of one or more layers obtained by using the high-band second index and the low-band third index.

3. The apparatus of claim 1, wherein:

the first error signal is an expression error signal which represents a difference between a low-band signal input to the low-band coder and a first synthetic signal synthesized using an excited signal generated from the low-band coder; and the second error signal is an expression error signal which represents a difference between a high-band signal input to the high-band coder and a second synthetic signal synthesized using an excited signal generated by the high-band coder using harmonic synthesis.

4. The apparatus of claim 1, wherein the low-band coder generates the low-band first index which is obtained by multiplexing a low-band signal input to the low-band coder using a code excited linear prediction (CELP) method.

5. The apparatus of claim 1, wherein the low-band coder has a CELP structure in which a high-band signal received using the CELP method is filtered, and an excited signal of the filtered high-band signal is generated by searching for a fixed codebook and an adaptive codebook.

6. The apparatus of claim 1, wherein:

the information required for coding the high-band signal comprises information on low-band pitch delay and information on a low-band excited signal energy; and the high-band coder uses a harmonic coding method so as to generate the high-band second index obtained by multiplexing a first parameter obtained by quantizing a linear prediction coding coefficient, a second parameter which determines a harmonic component to be coded by using the information on pitch delay received from the low-band coder and which is obtained by quantizing a harmonic phase based on the determined result, and a third parameter obtained by quantizing a high-band effective power by using the information on low-band excited signal energy received from the low-band coder.

7. A scalable speech coding method having a mixed structure, the method comprising:

(a) dividing a speech input signal into a low-band signal and a high-band signal according to a specific frequency, and outputting the low-band signal and the high-band signal;

(b) generating and outputting a low-band first index by coding the output low-band signal, and outputting specific information required for coding the high-band signal and a first error signal obtained from the low-band signal;

(c) coding the output high-band signal by using the specific information, and outputting a high-band second index and a second error signal obtained from the high-band signal;

(d) obtaining a wide-band third index from the first and second error signals using a modified discrete cosine transform (MDCT); and (e) outputting a scalable bit-stream composed of the low-band first index, the high-band second index, and the wide-band third index.

8. The method of claim 7, wherein the bit-stream is combined with narrow-band information composed of one or more layers obtained by using the low-band first index, and wide-band information composed of one or more layers obtained by using the high-band second index and the low-band third index.

9. The method of claim 7, wherein:

the first error signal is an expression error signal which represents a difference between a low-band signal input to the low-band coder generating the first index, and a first synthetic signal synthesized by using an excited signal generated from the low-band coder; and the second error signal is an expression error signal which represents a difference between a high-band signal input to the high-band coder generating the second index, and a second synthetic signal synthesized by using an excited signal generated by the high-band coder using harmonic synthesis.

10. The method of claim 7, wherein, in (b), the first index is generated by multiplexing a low-band signal input to the low-band coder using a code excited linear prediction (CELP) method.

11. The method of claim 7, wherein:

the specific information comprises information on low-band pitch delay and information on a low-band excited signal energy; and the low-band coder uses a harmonic coding method so as to generate the high-band second index obtained by multiplexing a first parameter obtained by quantizing a linear prediction coding coefficient, a second parameter obtained by quantizing a harmonic phase based on the determined result, and a third parameter obtained by quantizing a high-band effective power using the information on low-band excited signal energy received from the low-band coder.

12. A non-transitory computer-readable medium comprising computer readable instructions implementing the method of claim 7.

13. A scalable speech decoding apparatus having a mixed structure, the apparatus comprising:

a bit-stream divider to receive a scalable bit-stream transmitted at a specific transmission rate according to a network condition, and to generate a low-band signal, a high-band signal, and a wide band signal by dividing the scalable bit-stream according to a frequency band used in reproduction;

a low-band decoder to receive the low-band signal into which the scalable bitstream is divided by the bit-stream divider, to decode and output the received low-band signal, and to transmit specific information required for decoding a high-band signal among coefficients decoded in a low-band;

a high-band decoder to decode and output the high-band signal into which the scalable bit-stream is divided by the bitstream divider, using the specific information;

a wide-band decoder to decode the wide-band signal into which the scalable bitstream is divided by the bit-stream divider, and to divide and output the decoded wide-band signal into a low-band signal and a high-band signal according to a specific frequency; and a band combiner to output a wide-band synthetic signal of a combined band using a signal output from the low-band decoder, a signal output from the high-band decoder, the low-band signal output from the wide-band decoder, and the high-band signal output from the wide-band decoder.

14. The apparatus of claim 13, wherein the wide-band synthetic signal comprises a low-band output having one or more layers of low-band signal, and a wide-band output having one or more layers of high-band signal and wide-band signal.

15. The apparatus of claim 13, wherein the low-band decoder decodes an input bit-stream using a code excited linear prediction (CELP) method.

16. The apparatus of claim 13, wherein:

the specific information comprises a low-band pitch signal; and the high-band decoder obtains a harmonic position by using the low-band pitch signal, and decodes the received bit-stream by using harmonic information associated with the obtained harmonic position.

17. A scalable speech decoding method having a mixed structure, the method comprising:

(a) receiving a scalable bit-stream transmitted at a specific transmission rate according to a network condition, and dividing and outputting the scalable bit-stream into a low-band signal, a high-band signal, and a wide-band signal according to a frequency band used for reproduction;

(b) receiving the low-band signal of the scalable bitstream, decoding and outputting the received low-band signal, and outputting information on a pitch signal among coefficients decoded in a low-band;

(c) receiving the high-band signal of the scalable bitstream and the pitch signal information, and decoding and outputting the high-band signal by using the pitch signal information;

(d) receiving and decoding the wide-band signal of the scalable bitstream, and dividing and outputting the decoded wide-band signal into a low-band signal and a high-band signal according to a specific frequency; and (e) outputting a wide-band synthetic signal of a combined band by using a signal output in (b), a signal output in (c), a low-band signal output in (d), and a high-band signal output in (d).

18. The method of claim 17, wherein the wide-band synthetic signal comprises a low-band output having one or more layers of low-band signal, and a wide-band output having one or more layers of high-band signal and wide-band signal.

19. The method of claim 17, wherein, in (b), an input bit-stream is decoded by using a code excited linear prediction (CELP) method.

20. The method of claim 17, wherein, in (c), a harmonic position is obtained by using the low-band pitch signal, and the received bit-stream is decoded by using harmonic information associated with the obtained harmonic position.

21. A non-transitory computer-readable medium comprising computer readable instructions implementing the method of claim 17.

22. A non-transitory computer readable medium comprising computer readable instructions implementing the method of claim 18.

23. A non-transitory computer readable medium comprising computer readable instructions implementing the method of claim 19.

24. A non-transitory computer readable medium comprising computer readable instructions implementing the method of claim 20.

25. A non-transitory computer readable medium comprising computer readable instructions implementing the method of claim 8.

26. A non-transitory computer readable medium comprising computer readable instructions implementing the method of claim 9.

27. A non-transitory computer readable medium comprising computer readable instructions implementing the method of claim 10.

28. A non-transitory computer readable medium comprising computer readable instructions implementing the method of claim 11.

29. A scalable speech coding method having a mixed structure, the apparatus comprising:

dividing a speech input signal into a low-band signal and a high-band signal according to a specific frequency, and outputting the low-band signal and the high-band signal;

outputting a low-band first index by coding a low-band signal, outputting information required for coding a high-band signal, and outputting a first error signal obtained from the low-band signal;

outputting a high-band second index obtained when the high-band signal is coded by using the information required for coding a high-band signal, and outputting a second error signal obtained from the high-band signal;

obtaining a wide-band third index from the first and second error signals using a modified discrete cosine transform (MDCT); and outputting a scalable bit-stream composed of the low-band first index, the high-band second index, and the wide-band third index.

30. A non-transitory computer readable medium comprising computer readable instructions implementing the method of claim 29.

31. A scalable speech decoding method having a mixed structure for decoding a scalable bit-stream, the method comprising:

(a) receiving a low-band signal of the scalable bitstream, decoding and outputting the received low-band signal, and outputting information on a pitch signal among coefficients decoded in a low-band;

(b) receiving a high-band signal of the scalable bitstream and the pitch signal information, and decoding and outputting the high-band signal by using the pitch signal information;

(c) receiving and decoding a wide-band signal of the scalable bitstream, and dividing and outputting the decoded wide-band signal into a low-band signal and a high-band signal according to a specific frequency; and (d) outputting a wide-band synthetic signal of a combined band by using a signal output in (a), a signal output in (b), a low-band signal output in (c), and a high-band signal output in (c).

32. A non-transitory computer readable medium comprising computer readable instructions implementing the method of claim 31.

* * * * *